United States Patent [19]

Schmidt et al.

[11] 4,144,894

[45] Mar. 20, 1979

[54] RECONSTITUTED TOBACCO COMPOSITION AND PROCESS FOR MANUFACTURING SAME

[75] Inventors: Otto K. Schmidt, South Windsor; Robert P. Taylor, Vernon, both of Conn.

[73] Assignee: AMF Incorporated, White Plains, N.Y.

[21] Appl. No.: 811,022

[22] Filed: Jun. 29, 1977

[51] Int. Cl.[2] ..... A24B 3/14

[52] U.S. Cl. ..... 131/17 AC; 131/140 C

[58] Field of Search ..... 131/17 R, 17 A, 17 AC, 131/17 AD, 17 AE, 140 C

[56] References Cited

FOREIGN PATENT DOCUMENTS 213406 2/1958 Australia ..... 131/17 AC

*Primary Examiner*—Robert W. Michell
*Assistant Examiner*—V. Millin
*Attorney, Agent, or Firm*—George W. Price; Charles J. Worth

[57] ABSTRACT

Reconstituted tobacco compositions comprising tamarind gum as an adhesive agent, and processes for preparing reconstituted tobacco at high solids levels with controlled viscosity.

6 Claims, No Drawings

RECONSTITUTED TOBACCO COMPOSITION AND PROCESS FOR MANUFACTURING SAME

BACKGROUND OF THE INVENTION

1. Field of the Invention

This invention relates to the field of reconstituted tobacco compositions and processes for their manufacture, and more particularly, to shaped structures of reconstituted tobacco containing tamarind polysaccharide gum as the film forming adhesive, or binder, for the individual tobacco particles comprising the same.

2. Description of the Prior Art

Numerous reconstituted tobacco compositions and processes for their manufacture ae known, in which tobacco particles are formed into a coherent integral structure such as a rod or sheet which is thereafter used as binder or wrapper in cigars or as filler in cigarettes. The reconstituted structures desirably also exhibit strength and selective surface properties for aesthetics and handling, as well as required flexural properties for processing through tobacco machinery, rendering formulation a critical aspect of manufacturing operations.

Although various methods of manufacture may be employed, most commonly the composition is rendered formable by the use of dispersible materials as in an aqueous slurry for casting, or is heated and masticated for extrusion. In both cases, an adhesive or bonding agent is employed to aid in the development of the desired properties of the formed product.

Such materials are typically of significant viscosity under operating conditions. Accordingly, it has been the custom and practice to employ e.g., cellulose based materials of selected specific viscosity grade to provide the necessary flow characteristics to the composition during forming operations at particular temperatures. The specifics of the system in turn limit the proportion of tobacco or solids level which may be introduced to a given composition.

Numerous film-forming polysaccharide adhesive gums have been described for use in the manufacture of reconstituted tobacco sheet: galactomannan gum, guar gum, locust bean gum (U.S. Pat. No. 2,708,175); cellulose glycolic acid, hydroxyethyl carboxymethyl cellulose, viscose, polyuronides such as the pectins; algins and derivatives of these compositions (U.S. Pat. No. 2,769,734); a polysaccharide gum such as gum karaya or gum tragacanth in combination with a dialdehyde polysaccharide (U.S. Pat. No. 2,887,414); hydroxyethyl amylose having not more than 0.15 hydroxyethyl groups per glucose unit (U.S. Pat. No. 3,009,835); ethyl hydroxyethyl cellulose (U.S. Pat. Nos. 3,042,552 and 3,795,250); a mixture of Xanthomonas hydrophilic colloid and locust bean gum (U.S. Pat. No. 3,480,018); a water-soluble xanthan gum derivative, preferably in admixture with a water-soluble cellulose derivative such as methylcellulose, hydroxyethylcellulose, ethyloxyethylcellulose, and the like U.S. Pat. No. 3,542,035); and ether, ester and mixed etherester substituted galactomannan gum (U.S. Pat. No. 3,821,959).

In one common manufacturing method, the reconstituted tobacco composition including one or more of the foregoing adhesive agents is dispersed in an aqueous slurry, cast onto a supporting surface and dried. None of the foregoing polysaccharide gums or combinations thereof have permitted the casting of slurries containing substantially more than about 9–11% solids. Also, the reconstituted tobacco sheets manufactured with such gums have a tendency to adhere to the casting surface with the result that the doctor blade used for the separation of the sheet from the casting surface must be frequently replaced (e.g., at the end of each mill roll of 4000 to 6000 linear feet) to provide clean doctoring and to avoid shaving of the tobacco sheet which would impair the physical properties of the product.

Further, such adhesive agents exhibit a tendency to heat crack during drying, requiring the additional introduction to the compositions of a thermogelling gum.

SUMMARY OF THE INVENTION

It has been surprisingly discovered that the use of tamarind gum as a film-forming adhesive in the manufacture of reconstituted tobacco structures permits the forming e.g., casting of a slurry having a substantially greater solids concentration than heretofore possible with known and conventional gums, dispenses with the need for a companion thermo-gelling gum and provides a tobacco sheet which is practically self-releasing from the casting surface.

Broadly stated, the reconstituted tobacco structures of this invention comprise finely divided tobacco particles bonded together in a continuous, integral, coherent structure, preferably as rod or sheet, including tamarind gum as a bonding agent.

The reconstituted tobacco structures herein may be prepared by providing an aqueous slurry comprising finely divided tobacco and tamarind gum,; forming the slurry into a structured product, and drying to a selected moisture condition in a supported condition. Ordinarily, the slurry will be cast onto a belt and dried until self-supporting.

The intermediate compositions are especially valuable in that they offer constant composition over a range of viscosities responsive to temperature.

While castable tobacco slurries prepared with known and conventional polysaccharide gums are of relatively low soluble solids concentration, e.g., about 9–11% soluble solids, the use of tamarind gum in accordance with this invention permits the handling of slurries having solids contents of at least 12 e.g. 16 up to about 20%.

Due to the unique character of tamarind gum, greater viscosity is developed in the course of drying, and heat cracking of the tobacco sheet during drying is not encountered in the process of this invention. In contrast, aqueous solutions of known and conventional gums such as the cellulosic and galactomannan gums undergo a decrease in viscosity, shrink, and heat crack posing a serious threat to the integrity of the tobacco sheet. This disadvantage of known gum systems may be offset by the addition of a thermo-gelling gum and/or the addition of relatively high levels of fiber material, neither of which are necessary to the process of this invention.

Thus, where fiber content is employed in the reconstituted tobacco formulation, it has been found that only 2% of pulp (+ 50 CSF) produces a heat crack free tobacco sheet when employing a tamarind gum adhesive, as compared to 6–9% pulp required when using conventional gum adhesive.

Reconstituted tobacco formulations containing tamarind gum as the principal binding agent therefor are easily removed from the casting surface, with a resulting increase in the useful life of the doctor blade. Instead of employing a new doctor blade for one, or at most two, mill rolls, the life of the doctor blade herein is extended to from 8 to 10 mill rolls.

DESCRIPTION OF THE PREFERRED EMBODIMENTS

According to the process of this invention, finely divided tobacco is prepared from any and all parts of the tobacco plants such as leaves, stems and stalks. Different types of tobacco can be blended together if desired. It is preferable to clean the tobacco prior to comminuting or grinding. The tobacco is pulverized in any known and conventional apparatus such as by dry grinding in a ball mill, although wet grinding can also be used. The pulverized tobacco can be used as such but it is preferred to grade the tobacco particles according to size. Tobacco particles passing through a 100 mesh U.S. standard sieve are advantageously employed herein although particles as large as those passing through an 80 mesh sieve can also be used with good results.

Tamarind gum adhesive which is used as the tobacco particle binding agent herein is a polysaccharide derived from the seed kernels of the tamarind tree, *Tamarindus indica* (L), which is cultivated throughout India, Bangladesh, Ceylon and Burma. According to Industrial Gums, 2nd Edition, edited by Whistler et al., Academic Press, 1973 pages 369–411 (Tamarind, by Rao et al.), tamarind gum is a mixture of substances and in addition to polysaccharides such as D-galactose, 4-xylose and D-glucose and proteins, fiber, fat and inorganic salts, the gum also contains free sugars and tannins. Tamarind gum at present is employed as sizing in the textile industry due to it production of strong, smooth, continuous and elastic films. The de-fatted grade (i.e., solvent extracted, as by hexane, for example) of tamarind gum is preferred for use herein to maintain as high a level of organoleptic acceptance of the reconstituted tobacco as possible. Generally, any grade of tamarind gum which is free of an objectionable odor as used may be employed.

Tamarind gum is cold water insoluble and its degree of hydration with accompanying viscosity increase is temperature related. In the course of heating, the gum becomes gelatinized or hydrated. The temperature-viscosity relationship is demonstrated by the viscosity gradient obtained on 3% gum dispersions prepared at various water temperatures as follows:

| Viscosity of Gelatinized Tamarind Gum Effect of Water Temperature | |
|---|---|
| Water Temperature (° C.) | Solution Viscosity, (Brookfield viscometer, spindle 5 20 rpm.) |
| 40 | 25 CPS at 23° C. |
| 60 | 350 CPS at 23° C. |
| 80 | 1800 CPS at 23° C. |
| 100 | 1850 CPS at 23° C. |

It will be apparent that viscosity increases controllably with water temperature. This behavior of tamarind gum in water of different temperatures is used to advantage in the process of this invention as it permits the preparation of formable tobacco slurries of constant composition but different viscosity levels by selection of the appropriate make-up water temperature. The viscosity level of the tobacco slurries can also be regulated by employing only part of the tamarind gum in gelatinized form with the remainder of the gum dispersed in cold water. In such case, the cold water dispersed, i.e., non-gelatinized gum, although an integral part of the slurry, does not significantly contribute to the viscosity thereof in the unheated state since it is in unhydrated form. The viscosity of the gum can therefore be kept sufficiently fluid making it possible to incorporate relatively large proportions of tobacco in the slurries while yet maintaining a suitable level of viscosity. Heretofore slurries containing 85% tobacco required adjustment to 9–11% by weight total solids to provide acceptable film formation. By regulating the proportion of gelatinized tamarind gum to cold water dispersed tamarind gum according to this invention, the total solids content of the castable slurries can be up to about 20% by weight of the slurry.

Mixtures in all proportion of the gelatinized, hydrated or 'cooked' tamarind gum may accordingly be employed where desired with the 'uncooked' gum to afford selected flow characteristics to the slurry. Usually, a 50/50 admixture by weight is found most convenient.

It is also within the scope of this invention to employ a gum system containing up to as much as 50% by weight of one or more polysaccharide gums other than that derived from tamarind. Thus, for example, up to half the gum system used herein can be made up of galactomannan gum such as guar gum, locust bean gum, and the ether, ester and mixed etherester derivatives thereof. Generally, when an additional gum is employed, an amount of tamarind gum sufficient to afford belt release properties is combined therewith ordinarily at least 20 to 25% up to 40 to 50% of the total gum content. An exemplary such gum composition comprises a 50/50 admixture by weight of guar gum and tamarind gum.

Gelatinized solutions of tamarind gum can be prepared at widely varying concentrations depending upon the temperature of the water used for making the solution and the viscosity of the solution at the particular temperature and concentration selected. Solutions of from about 1% to about 5% tamarind gum can be readily prepared employing water having a temperature of from about 40° C. to about 100° C.

Tobacco powder is mixed with the gelatinized gum and/or cold water dispersed gum to form a slurry, typically until the tobacco constitutes about 85% of the weight of the slurry solids. It is understood, however, that the proportions of tobacco powder in the slurry are not critical herein and can be considerably less and even greater than this amount. In general, it is preferred to maintain the water content of the slurry at as low a level as possible in order to minimize the leaching of water soluble constituents, particular flavorants, from the tobacco powder. The adhesive formulation can also contain such known and conventional ingredients as glycerine (as a humectant), reinforcing fiber, flavorants, burn control additives, etc. The formulation may also be foamed in known manner to reduce the density and improve organoleptic properties.

In the finished tobacco sheet, the gum system can comprise between about 0.5% to about 33% of the weight of the product, and preferably, from about 1% to about 20% of the weight of the tobacco sheet. The viscosity of the castable tobacco slurry can be from about 500 to 500,000 centipoises and preferably is within the range of from about 6,000 and 30,000 centipoises.

To form a tobacco sheet in accordance with this invention, the tobacco slurry may be cast or extruded onto a supportive surface, preferably a continuous stainless steel belt as in U.S. Pat. No. 2,769,734 which is incorporated by reference herein. The slurry is then heated to a selected moisture condition e.g., 13 percent by weight or until self-supporting, for example, at a temperature of from about 40° C. to 90° C. Thickness and tensile strength of the dried tobacco sheet can be readily controlled by adjusting the nature and viscosity of the gum and the amount of slurry deposited on the casting surface.

Following drying of the tobacco sheet, the sheet may be remoistened to a predetermined extent, for example, to a moisture content in the range of from about 8% to about 30%, and preferably from about 10% to about 20%. As previously stated, one of the advantages of tamarind gum herein lies in the ease with which the moist (or remoistened) tobacco sheet is lifted from the moving casting surface. While the mechanism by which tamarind gum achieves this result is not completely understood, it can be theorized that in conventional gum systems, there is an exudation of water (syneresis) during the driving operation attendent the reduction in viscosity or shrinking of such gums which exudates include tobacco solubles of an adhesive nature and such adhesive solubles tend to hold the tobacco sheet onto the casting surface. It is believed that tamarind gum swells, i.e., hydrates, further during drying preventing the adhesive tobacco solubles from binding the tobacco sheet to the casting surface. This performance under heat stress is most remarkable in that locust bean gum which also reaches maximum viscosity upon heating is among those binders most susceptible to heat cracking.

Reconstituted tobacco structures as referred to herein comprise formed sheets, tubes, foils, rods and the like in continuous or comminuted form, raw or manufactured into filler, binder or wrapper, etc. for cigarettes and cigars. Smokable compositions based upon other combustible materials well known in the art including a variety of naturally occurring or cultivated vegetation may likewise be formed into similar structures as by recovery of scrap, stem or waste, or synthetic compositions may be similarly structured form e.g., cellulose or cellulose derivatives such as carboxymethyl cellulose with various organic or inorganic additives.

Each of the foregoing compositions may be formulated with humectants, flavorants, burn control substances, fibers, fillers and the like as is customary and well known in this art.

The following examples are illustrative of the reconstituted tobacco process and composition of this invention:

EXAMPLE I

Eighty-five parts of finely ground tobacco were mixed with 15 parts of a 3% aqueous gelatinized de-fatted tamarind gum solution and the homogeneous slurry was formed into a sheet on a continuous stainless steel belt, dried, moistened and removed from the belt as a finished sheet.

The reconstituted tobacco sheet had good physical characteristics as demonstrated by the following physical data:

| | |
|---|---|
| Sheet Weight: | 6.89-7.28 g/ft.$^2$ |
| Moisture: | 21.0-25.7% |
| Tensile Strength:* | 853 g/inch DL |
| | 475 g/inch DT |
| | 140 g/inch WL |
| | 87 g/inch WT |
| Density: | 0.36-0.40 g/cc |
| Color, Gardner: | 12.7-13.5 Rd |
| | 8.4-8.7 +a |
| | 19.7-20.3 +b |

*Tensile values are taken on a Scott tensile tester, and are reported as DL = dry, longitudinal; DT = dry, transverse; WL = wet, longitudinal; WT = wet, transverse, all as measured on test specimens of 1" width.

The sheet was shredded into cigarette filler with great ease and efficiency. The resulting product was considered to exhibit good aesthetic and organoleptic properties when tested by a smoking panel.

EXAMPLE II

A cigar broadleaf blend formulation known to exhibit poor belt release requiring change of the doctor blade at the end of each mill roll formed, and comprising as its binder 0.6 pts of guar gum, 0.3 pts. of sodium carboxymethyl cellulose and 0.1 pt. of methylcellulose was modified to the following binder system:

0.3 pts. guar gum
0.3 pts. tamarind gum (uncooked)
0.3 pts. NaCMC (grade 7 MF)
0.1 pt. methylcellulose (50CPS, HG60)

The foregoing binder system when employed at the same level in the identical formulation permitted continued use of the doctor blade over six (6) mill rolls without shaving, resulting in better product properties.

EXAMPLE III

A series of runs utilizing varying amounts of a 3% aqueous solution of defatted cooked (hydrated, or gelatinized) and uncooked tamarind gum, with formulations employing about 85 percent by weight of a tobacco blend, with and without added pulp, humectant or other binding agent were carried out in conventional manner using an aqueous slurry, cast and dried on a belt as described hereinabove. Results, including slurry solids level and viscosity, and sheet characteristics are outlined in Tables I and II following:

TABLE I

| | CONTROL | NO PULP | NO PULP 1/2/1/2 Cooked/Uncooked Tamarind | 2 × PULP | CONSTANT GUM/NO GUAR | CONSTANT GUM/2 × GUAR |
|---|---|---|---|---|---|---|
| Cooked Tamarind | 8.33 | 8.33 | 4.42 | 8.83 | 10.01 | 7.65 |
| Uncooked Tamarind | 0.0 | 0.0 | 4.41 | 0.0 | 0.0 | 0.0 |
| Guar DF | 1.18 | 1.18 | 1.18 | 1.18 | 0.0 | 2.36 |
| Pulp, No. 50 CSF | 2.35 | 0.0 | 0.0 | 4.70 | 2.35 | 2.35 |
| Triethylene glycol (humectant) | 3.53 | 3.53 | 3.53 | 3.53 | 3.53 | 2.53 |
| Glyoxal (insolubilization agents) | 1.77 | 1.77 | 1.77 | 1.77 | 1.77 | 1.77 |
| Tobacco (50/50 Virginia bright scrap leaf) (Wrapper Burley stems) | 100 | 100 | 100 | 100 | 100 | 100 |

TABLE I-I

| | CONTROL | NO PULP | NO PULP 1/2/1/2 Cooked/ Uncooked Tamarind | 2 × PULP | Constant Gum/No Guar | Constant Gum/2 × Guar |
|---|---|---|---|---|---|---|
| Sheet Moisture % | 17.7, 13.8, 12.7 | 13.1 | 12.4 | 11.4 | 14.9 | 13.0 |
| DLTF (gm/in)[1] | 90, 120, 134 | 110 | 98 | 203 | 72.8 | 145 |
| WT TF (gm/in)[2] | 16., 9.6, 10.9 | 12.0 | 7.6 | 13.2 | 9.4 | 12.3 |
| WET Orientation Factor[3] | 1.42, 1.70, 2.01 | 0.95 | 1.27 | 2.06 | 1.36 | 1.87 |
| DENSITY (gm/cc) | 0.45, 0.44, 0.36 | 0.45 | 0.43 | 0.47 | 0.36 | 0.38 |
| SLURRY SOLIDS % | 16.9, 15.7, 16.1 | 16.3 | 16.0 | 15.7 | 16.8 | 15.9 |
| SLURRY VISC, CPS (Brookfield, spindle #6 | 2,350, 27,000, 24,000 | 11,000 | 7,600 | 25,000 | 19,000 | 22,500 |

[1]DLTF = $\frac{\text{Dry Longitudinal breaking strength}}{\text{Sheet Weight}}$; measured on a Scott tensile tester on a 1 inch wide test specimen.

[2]WTTF = $\frac{\text{Wet transverse breaking strength}}{\text{Sheet weight}}$; measured on a Scott tensile tester on a 1 inch wide test specimen.

[3]Wet Orientation Factor = $\frac{\text{Longitudinal wet strength}}{\text{Transverse wet strength}}$

TABLE II

| | CONTROL | GUM RATIO FIXED 25% Increase | GUM RATIO FIXED 25% Decrease | NO HUMECTANT | TAMARIND 50/50 C/UC | UNCOOKED TAMARIND |
|---|---|---|---|---|---|---|
| Cooked Tamarind | 8.33 | 11.16 | 6.49 | 8.83 | 4.42 | 0.0 |
| Uncooked Tamarind | 0.0 | 0.0 | 0.0 | 0.0 | 4.41 | 8.83 |
| Guar DF | 1.18 | 1.49 | 0.87 | 1.18 | 1.18 | 1.18 |
| Pulp, No. 50 CSF | 2.35 | 2.35 | 2.35 | 2.35 | 2.35 | 2.35 |
| Triethylene glycol (humectant) | 3.53 | 3.53 | 3.53 | 0.0 | 3.53 | 3.53 |
| Glyoxal (insolubilization agents) | 1.77 | 1.77 | 1.77 | 1.77 | 1.77 | 1.77 |
| Tobacco (50/50 Virginia bright scrap leaf) (Wrapper Burley stems) | 100 | 100 | 100 | 100 | 100 | 100 |

TABLE II-II

| | CONTROL | GUM RATIO FIXED 25% Increase | GUM RATIO FIXED 25% Decrease | NO HUMECTANT | TAMARIND 50/50 C/UC | UNCOOKED TAMARIND |
|---|---|---|---|---|---|---|
| Sheet Moisture | 17.7, 13.8, 12.7 | 15.2 | 16.3 | 12.0 | 12.8 | 12.8 |
| DLTF (gm/in)[1] | 90, 120, 134 | 66.5 | 82.8 | 143 | 99 | 96 |
| WT TF (gm/in)[2] | 16.0, 9.6, 10.9 | 8.5 | 9.3 | 17.6 | 11.1 | 10.5 |
| WET Orientation Factor[3] | 1.42, 1.70, 2.01 | 1.56 | 1.91 | 1.33 | 1.51 | 2.03 |
| DENSITY (gm/cc) | 0.45, 0.44, 0.36 | 0.39 | 0.37 | 0.36 | 0.36 | 0.44 |
| SLURRY SOLIDS % | 16.9, 15.7, 16.1 | 16.7 | 15.9 | 15.8 | 15.8 | 17.1 |
| SLURRY VISC, CPS (Brookfield, spindle #6 | 2,350, 17,000 24,000 | 24,000 | 17,000 | 23,500 | 15,000 | 14,000 |

[1]DLTF = $\frac{\text{Dry Longitudinal breaking strength}}{\text{Sheet Weight}}$; measured on a Scott tensile tester on a 1 inch wide test specimen

[2]WTTF = $\frac{\text{Wet transverse breaking strength}}{\text{Sheet weight}}$; measured on a Scott tensile tester on a 1 inch wide test specimen.

[3]Wet Orientation Factor = $\frac{\text{Longitudinal wet strength}}{\text{Transverse wet strength}}$

What we claim is:

1. In an aqueous slurry composition for the preparation of a reconstituted tobacco material comprising particulate tobacco and an adhesive agent therefor the improvement which comprises employing as said adhesive agent a sufficient amount of tamarind gum to render said composition formable into continuous coherent integral shaped structures at a solids level of at least 12 by weight.

2. A continuous coherent integral shaped structure comprising a multiplicity of discrete tobacco particles bonded at a plurality of points with an adhesive agent comprising tamarind gum.

3. The smoking composition of claim 2, wherein said structutre comprises at least 50 percent by weight of particulate tobacco.

4. The smoking composition of claim 2, wherein said structure comprises cellulose or cellulose derivatives.

5. The structure of claim 2 also comprising guar gum.

6. A process for forming a reconstituted tobacco composition into a coherent integral shaped structure comprising dispersing a tobacco-containing composition in an aqueous slurry to a solids level of at least about 12 percent by weight with from about 2 to about 15 percent by weight tamarind gum, casting said slurry as a continuous sheet upon a supporting surface, and drying.

* * * * *

UNITED STATES PATENT AND TRADEMARK OFFICE

CERTIFICATE OF CORRECTION

PATENT NO. : 4,144,894

DATED : March 20, 1979

INVENTOR(S) : Otto K. Schmidt & Robert P. Taylor

It is certified that error appears in the above-identified patent and that said Letters Patent are hereby corrected as shown below:

In Claim 1, line 7, after "12" add --%--.

Signed and Sealed this

*Fourth* Day of *September 1979*

[SEAL]

*Attest:*

*Attesting Officer*

LUTRELLE F. PARKER

*Acting Commissioner of Patents and Trademarks*